US006626293B2

(12) United States Patent
St. Jeor

(10) Patent No.: US 6,626,293 B2
(45) Date of Patent: Sep. 30, 2003

(54) GOLF CLUB REMINDER DEVICE

(75) Inventor: Wallace E. St. Jeor, 1476 E. Vineyard Dr., Bountiful, UT (US) 84010

(73) Assignee: Wallace E. St. Jeor, Bountiful, UT (US)

( * ) Notice: Subject to any disclaimer, the term of this patent is extended or adjusted under 35 U.S.C. 154(b) by 0 days.

(21) Appl. No.: 10/075,549

(22) Filed: Feb. 13, 2002

(65) Prior Publication Data

US 2002/0108873 A1 Aug. 15, 2002

Related U.S. Application Data

(60) Provisional application No. 60/268,518, filed on Feb. 14, 2001.

(51) Int. Cl.[7] ..... A63B 55/04
(52) U.S. Cl. ..... 206/315.6; 116/173
(58) Field of Search ..... 206/315.6, 315.2, 206/315.3; 116/173

(56) References Cited

U.S. PATENT DOCUMENTS 1,826,216 A * 10/1931 Johnson ..... 206/315.3
2,045,147 A * 6/1936 Johnson ..... 206/315.3
2,595,987 A * 5/1952 Shears ..... 206/315.2
4,746,014 A 5/1988 Very
4,944,396 A 7/1990 Larkin
4,967,904 A * 11/1990 Quellais et al. ..... 206/315.3
5,398,927 A * 3/1995 O'Sullivan
5,772,024 A * 6/1998 Lueders ..... 206/315.6
5,950,823 A 9/1999 Flis
6,216,864 B1 * 4/2001 Chang ..... 206/315.2

* cited by examiner

*Primary Examiner*—Tri M. Mai
(74) *Attorney, Agent, or Firm*—Thorpe North & Western, llp

(57) ABSTRACT

A device for indicating absence of a golf club from a golf club housing includes an elongate rod having a top end, a base end, and an intermediate length less than a length of the golf club housing, the elongate rod being configured to be completely contained within the golf club housing upon insertion of the golf club into the housing. A compliant biasing element is configured for positioning at a bottom portion the golf club housing and is coupled to the base end of the elongate rod and configured to extend and retract with the elongate rod independently of the golf club housing. The biasing element has a reactive spring force greater than a weight of the elongate rod and less than a combined weight of the elongate rod and the golf club, the compliant biasing element is configured (i) to compress and allow the elongate rod to retract into the golf club housing in response to the weight of the golf club upon insertion of a golf club into the housing and (ii) to extend the elongate rod beyond a top of the housing upon removal of the golf club from the housing.

3 Claims, 6 Drawing Sheets

GOLF CLUB REMINDER DEVICE

This Application claims priority to U.S. Provisional Application No. 60/268,518, filed Feb. 14, 2001, in the United States Patent and Trademark Office.

BACKGROUND OF THE INVENTION

1. Field of the Invention

The present invention relates generally to device for indicating the absence of a golf club from a golf club housing.

2. Related Art

Golf is a sport enjoyed by people of all backgrounds. A typical golfer is armed with a collection of golf clubs which are used to strike a golf ball in an effort to hit the golf ball into a hole contained on the green. Golf clubs typically come in a range of lengths and club face angles. The variation in golf club length and face angle produces differing trajectories when used to strike a golf ball. For instance, the driver, or one wood, is generally the longest club with the steepest club face angle and is used to hit the golf ball in a low, long trajectory to move the ball long distances. In contrast, the "short" irons are shorter than the driver with shallower club faces and are used to hit the ball into higher, shorter trajectories. In this manner, golfers can use the same swing but achieve different ball trajectories by choosing different clubs. The longer clubs are used to send the ball longer distances, such as when a player is far from the green. The shorter clubs are used to precisely control the end position of the ball, such as when the player approaches the green and desires to place the ball very close to the hole.

A player's golf clubs are generally carried in a bag designed for the purpose. Most conventional golf bags are partitioned, either in sections separated by barriers, or with insert tubes, or both. A player can organize his or her golf clubs according the length and club face angle of the club. Thus, when a particular situation calls for a particular club, the player removes that club from the bag and executes the shot. The player then generally replaces the club in the bag and proceeds to the next shot, hopefully some distance closer to the hole. The player's golf bag can be carried by the player, can be mounted on and rolled by a rolling hand cart, or can be mounted on and carried on a motorized golf cart. The player is typically not allowed to roll or drive the bag cart in areas immediately surrounding the green and tee area.

In some cases a player may remove two or more clubs at one time and travel a distance from the bag before striking the next shot. Such a situation may occur, for instance, when a player's ball has landed on or near the green. The green is generally a well-tended area of the golf course and is reserved for putting. Accordingly, golfers generally leave behind their golf bags and carry only the club that they will require near the green. If a player's ball is on the green, the player need only remove his or her putter from the bag and proceed to putt. However, in many situations, a player is unsure of the "lie" of the ball, and hence, unsure of which club will be necessary when they arrive at their ball. In this case, a player might remove his or her putter and pitching or sand wedge from the bag, and proceed to the ball. Once at the location of the ball, the player might then place on the ground the club or clubs he or she doesn't need and proceed with the shot.

Unfortunately, in the excitement of the consequent play, the player can forget to retrieve the clubs he or she left on the ground and simply replace in the bag the club he did remember. The player might then proceed to the next hole, or to the clubhouse, without realizing he left a club or clubs lying on the golf course. In this manner, a player's clubs can be lost or damaged. Of course, replacing or repairing golf clubs can be an expensive proposition.

In an effort to prevent the absentminded golfer from losing golf clubs, reminder devices have been developed to alert the player that a club is missing from his bag. However, these devices can be problematic in that they are often overly complex and inconvenient to use. Such devices have been developed which consist of an inner tube surrounded by an outer tube. The golf club is inserted into the inner tube and, when the club is removed, the inner tube extends upwardly in an effort to serve as a reminder that a club has been removed.

These devices have proved problematic in that they are inconvenient to use because they can interfere with the insertion and removal of the club. Most such devices attempt to indicate a missing club by elevating the tube which otherwise contains the club. Consequently, they are prone to malfunction due to the mechanical interface of the two tubes, which can cause wear and seizure between the tubes with continued use. In addition, they can adversely affect the ease with which the golf club is placed into and removed from the tube, creating an undesirable distraction. They can also require the addition to the golf bag of extraneous securing structure, in order to prevent the reminder devices from moving relative to the golf bag.

SUMMARY OF THE INVENTION

It has been recognized that it would be advantageous to develop a golf club reminder device that alerts a golfer of the absence of a golf club but which does not interfere with the insertion and removal of the club from a golf bag.

The present invention provides a device for indicating absence of a golf club from a golf club housing and includes an elongate rod having a top end, a base end, and an intermediate length less than a length of the golf club housing, the elongate rod being configured to be completely contained within the golf club housing upon insertion of the golf club into the housing.

A compliant biasing element is configured for positioning at a bottom portion of the golf club housing and is coupled to the base end of the elongate rod and is configured to extend and retract with the elongate rod independently of the golf club housing.

The biasing element has a reactive spring force greater than a weight of the elongate rod and less than a combined weight of the elongate rod and the golf club. The compliant biasing element is configured (i) to compress and allow the elongate rod to retract into the golf club housing in response to the weight of the golf club upon insertion of a golf club into the housing and (ii) to extend the elongate rod beyond a top of the housing upon removal of the golf club from the housing.

In accordance with a more detailed aspect of the present invention, the device includes an indicia coupled to the top end of the elongate rod configured to alert a person viewing the indicia of the absence of a missing golf club.

In accordance with a more detailed aspect of the present invention, the indicia comprises a flag.

In accordance with a more detailed aspect of the present invention, the indicia conveys information relating to identification of the missing golf club that has been removed.

In accordance with a more detailed aspect of the present invention, the device includes an end cap configured to cover a bottom of the golf club housing and means for simultaneously attaching the end cap to the bottom of the golf club housing and attaching and restraining the compliant biasing element to the bottom portion of the housing.

In accordance with a more detailed aspect of the present invention, the device includes a golf club support base coupled to a top of the compliant biasing element to contact an inverted top of the golf club when inserted into the housing.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

FIG. 5*b* is a side cut-away view of the embodiment of the present invention illustrated in FIG. 5*a.

DETAILED DESCRIPTION

Figure 1A:
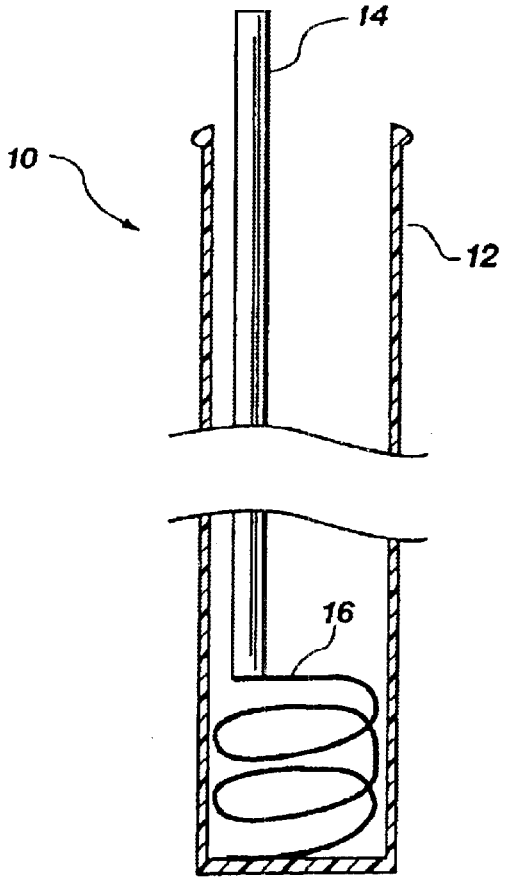
FIG. 1*a* is a side cut-away view of a golf club reminder device in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the invention as illustrated herein, which would occur to one skilled in the relevant art and having possession of this disclosure, are to be considered within the scope of the invention.

Figure 1B:
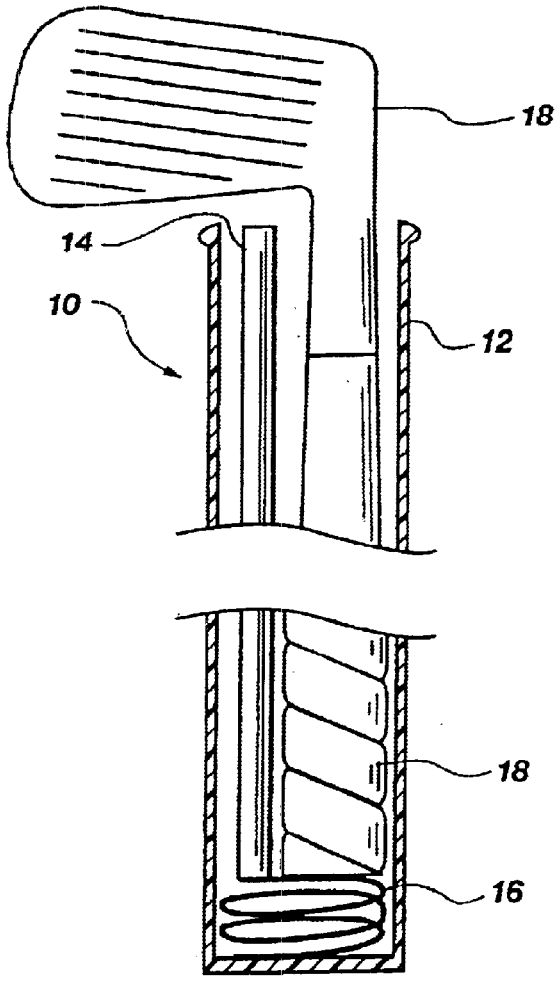
FIG. 1*b* is a side cut-away view of the embodiment of the present invention illustrated in FIG. 1*a;*

As illustrated in FIGS. 1*a* and 1*b,* a system, indicated generally at 10, in accordance with the present invention is shown for a golf club reminder device. The device can be placed in a golf club bag and used to store golf clubs. Upon removal of a club from the bag, the device indicates that the club has been removed from the bag. In accordance with one aspect of the present invention, the system 10 can be used with a golf club housing 12. An elongate rod 14 is provided that has a length less than the length of the golf club housing. A compliant biasing element 16 is coupled to the elongate rod and the golf club housing. As a golf club 18 is inserted into the housing, the top end of the inverted golf club, i.e., the end generally including a grip, contacts the top of the compliant biasing element. As the golf club is allowed to fall into the housing, the combined weight of the golf club and the elongate rod compress the compliant element and the elongate rod is retracted into the housing. After removal of the golf club, the elongate rod again protrudes above the golf club housing.

The device, after the insertion of a golf club, is illustrated in FIG. 1*b.* It will be appreciated that the elongate rod is completely contained within the golf club housing. The compliant element has a reactive spring force greater than the weight of the elongate rod and less than the combined weight of the elongate rod and the golf club. Thus, upon removal of the golf club, the compliant element expands and forces the elongate rod above the top of the housing. The present device accordingly indicates the removal of the golf club from the housing, reminding the golfer that he or she has neglected to replace the club. It will be appreciated that the present invention operates independently of the golf club housing and so provides very little resistance to the insertion and removal of the golf club from the housing.

Figure 2A:
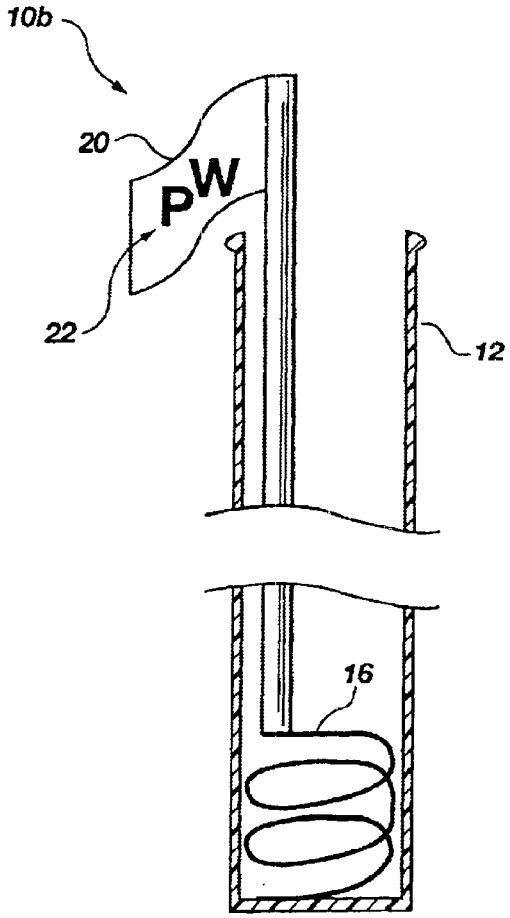
FIG. 2*a* is a side cut-away view of another embodiment of the present invention.
Figure 2B:
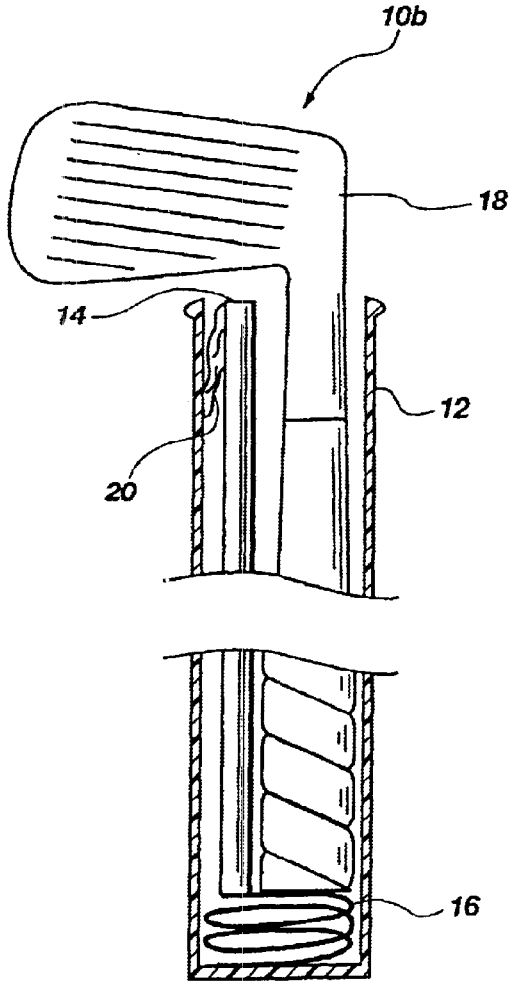
FIG. 2*b* is a side cut-away view of the embodiment of the present invention illustrated in FIG. 2*a;*

The golf club housing 12 can be of any type. In a preferred embodiment, the housing is comprised of a generally tubular structure manufactured for the storage of golf clubs. Thus, the present invention can be utilized with housings that are presently commercially available and can be readily adapted for use with the present invention. In addition to providing the elongate rod 14 to indicate the absence of a golf club, an embodiment of the invention can include an indicia bearing medium or indicia 20 coupled to the elongate rod. As indicated by embodiment 10*b* in FIGS. 2*a* and 2*b,* the indicia bearing medium or indicia 20 can be coupled to the top of the elongate rod to protrude above the top of the housing upon removal of a golf club from the housing. When the golf club is returned to the housing, the compliant biasing element compresses and retracts the elongate rod, and thus the indicia bearing medium, below the top of the housing. Accordingly, an aesthetically pleasing golf club reminder is provided that displays an indicia to indicate the absence of a golf club.

Figure 3:
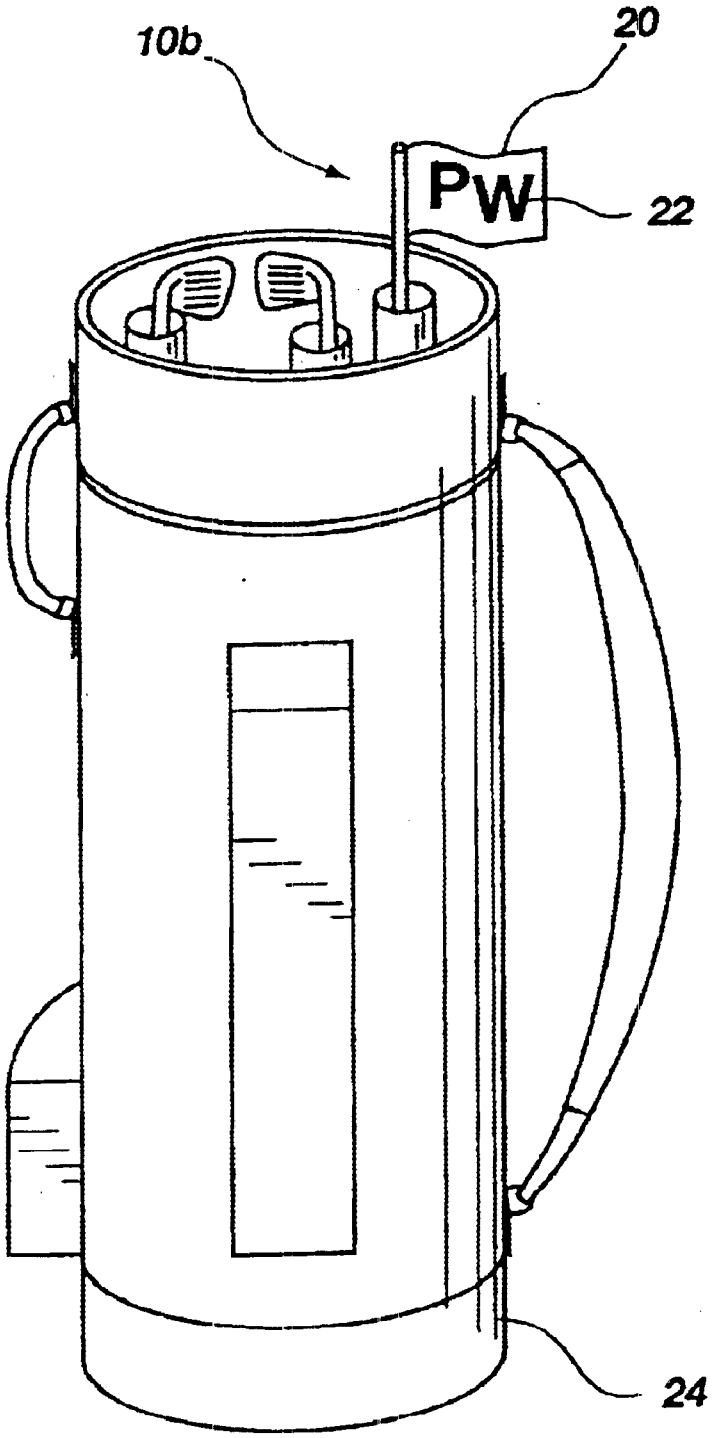
FIG. 3 is a side perspective view of the present invention in use.

The indicia bearing medium or indicia 20 can be of any type known to those skilled in the art. In one embodiment of the present invention, the indicia bearing medium can be formed as flag. The flag can resemble the type of flags used on golf "pins," which are kept in the golf hole on the green to indicate the location of the hole. The flag can be constructed of a variety of materials and can include colors and patterns. FIG. 3 illustrates a possible use of the present invention, as it would appear installed in a golf bag 24 after removal of a golf club.

In one embodiment of the present invention, the indicia bearing medium can convey information 22 related to the identity of the club that has been removed. For example, the indicia may include the initials commonly used to designate the particular club, such as "PW" for pitching wedge, or "SW" for sand wedge. The initial can also be a number, such as a seven or a nine, which corresponds to the number of an iron or a wood club. Alternately, the indicia could be information relating to a company or an event. For example, a corporation sponsoring a particular golfing event can print the company logo on the indicia bearing medium and distribute the golf club reminder device to patrons of the event.

Figure 4A:
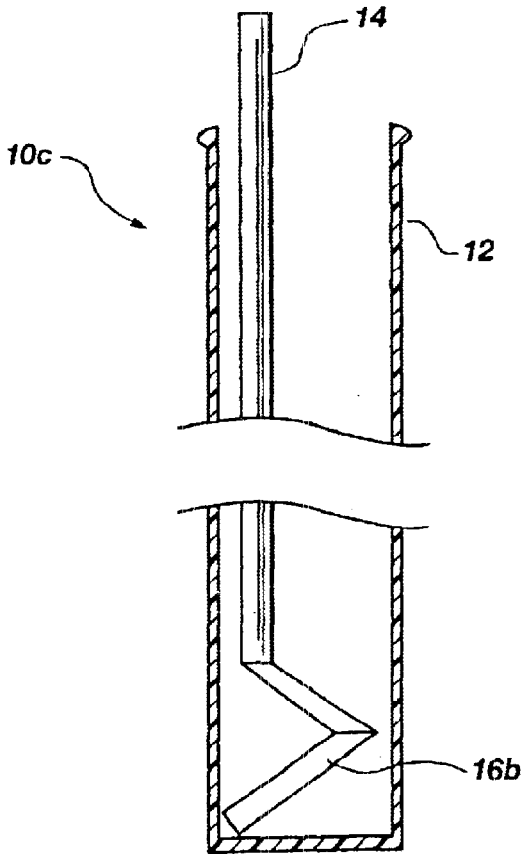
FIG. 4*a* is a side cut-away view of another embodiment of the present invention.
Figure 4B:
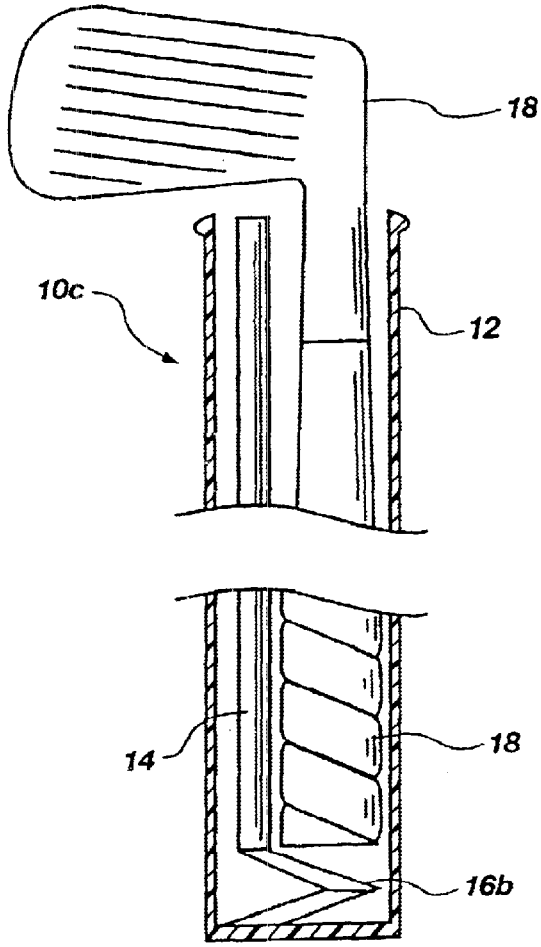
FIG. 4*b* is a side cut-away view of the embodiment of the present invention illustrated in FIG. 4*a;*

The compliant biasing element can be made as a spring, as illustrated in FIGS. 1*a* through 2*b.* Alternately, it can be configured as any compliant mechanism capable of providing a reactive force. In one embodiment of the present invention, the compliant biasing element can comprise a single flexible element, as illustrated by embodiment 10*c* in FIGS. 4*a* and 4*b*. The biasing element can be coupled to the housing and the elongate rod. Upon removal of the golf club, the biasing element expands and lifts the elongate rod above the top of the housing. After the golf club is inserted into the housing, the biasing element compresses and retracts the top of the elongate rod into the housing.

Figure 5A:
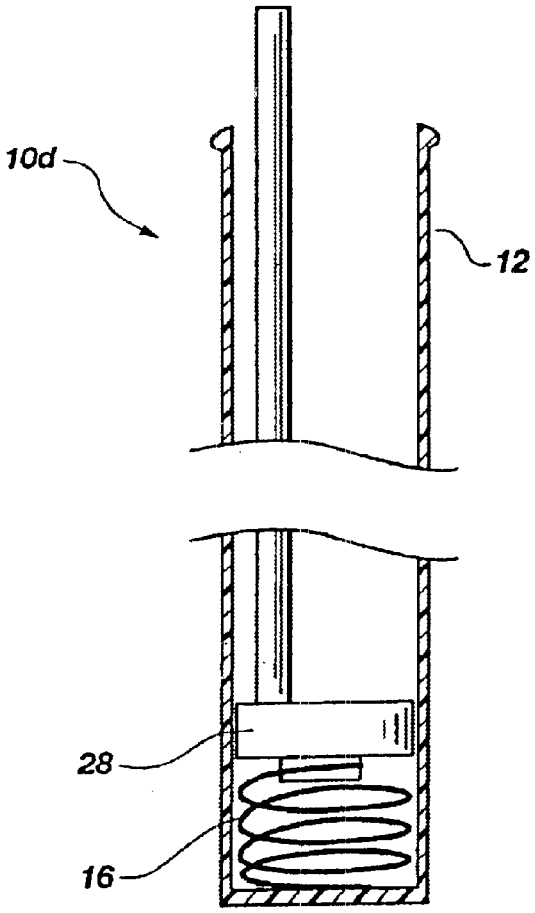
FIG. 5*a* is a side cut-away view of another embodiment of the present invention.
Figure 5B:
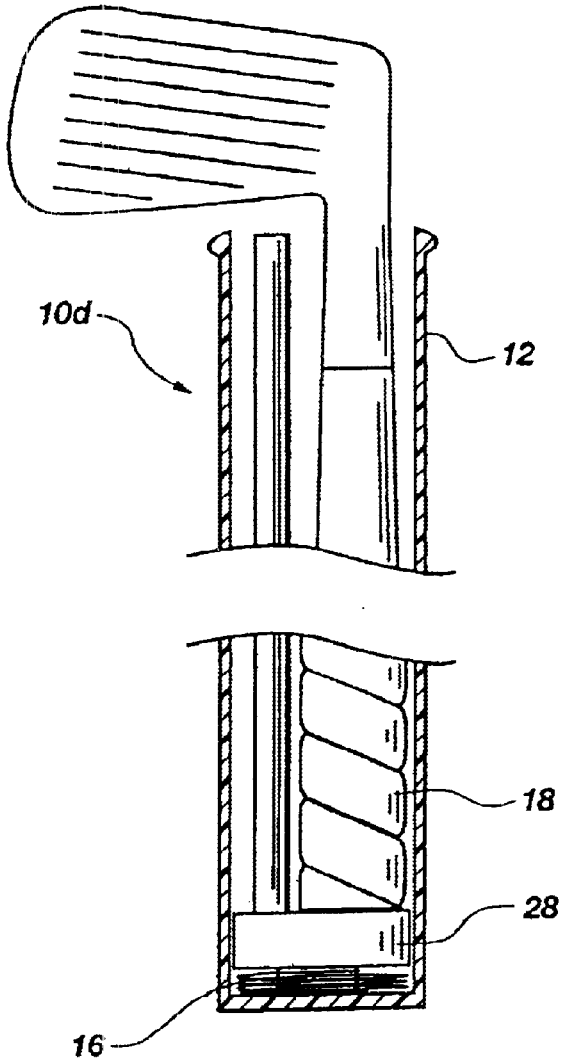

To better facilitate the interaction between the top end of the golf club 18 and the compliant biasing element 16, a golf club support member 28 can be coupled to the top of the biasing element. In the embodiment 10*d* illustrated in FIGS. 5*a* and 5*b*, the end of the golf club rests on top of the support member, which transfers the weight of the golf club to the compliant element when the golf club is inserted into the housing 12. The support member can aid in maintaining the alignment of the biasing element as it travels up and down the inside of the housing. The support member can be made of any material, but is preferably formed of a relatively low friction material, to minimize frictional interference as the support member travels inside the housing.

Figure 6:
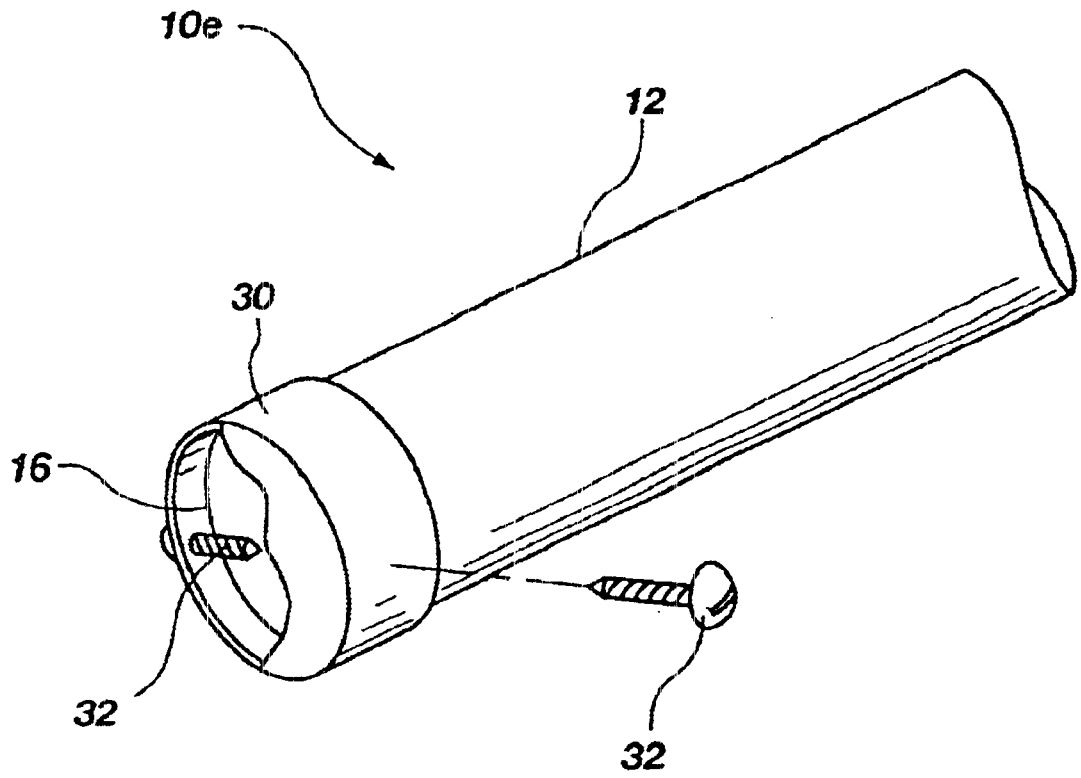
* and FIG. 6 is a side perspective view of another embodiment of the present invention.

Another embodiment 10*e* of the present invention is illustrated in FIG. 6, in which an end cap 30 (shown in partial cutaway view) can be installed on the bottom end of the housing 12. This embodiment can provide a cost effective and reliable system for installing the compliant biasing element 16 inside the housing 12. After the end cap is installed on the housing, the biasing element can be forced against the end cap. Attachment means 32 can then be applied through the end cap and protrude inside the housing 12. As the attachment means protrude through the housing, the bottom of the biasing element is secured between the attachment means and the end cap to prevent the biasing element from moving relative to the housing. The attachment means can be screws, bolts, nails, or any known to those skilled in the art.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. A golf club housing device, comprising:

an elongate chamber configured to receive and store a golf club;

a compliant biasing element, coupled to the elongate chamber;

a golf club support base coupled to a top of the compliant biasing element and being configured to contact a top of the golf club when the golf club is inverted and inserted into the elongate chamber;

an elongate rod coupled to and extending vertically upward from the support base;

an indicia bearing medium coupled to a top of the elongate rod, the indicia medium comprising a flag; and a reactive spring force of the compliant biasing element being greater than a combined weight of the elongate rod, the indicia bearing medium and the support base, and less than a combined weight of the elongate rod, the indicia bearing medium, the support base and the golf club, the compliant biasing element being configured (i) to compress and allow the elongate rod, and thus the indicia bearing medium, to retract into the elongate chamber upon insertion of a golf club into the chamber and (ii) to extend the elongate rod, and thus the indicia bearing medium, beyond a top of the elongate chamber upon removal of the golf club from the chamber.

2. A device in accordance with claim 1, further comprising:

an end cap configured to cover a bottom of the elongate chamber; and means for simultaneously attaching the end cap to an outside bottom of the elongate chamber and attaching and restraining a bottom of the compliant biasing element to the elongate chamber.

3. A device in accordance with claim 1, wherein the flag conveys information relating to the identification of the golf club that has been removed.

* * * * *